US005249793A

United States Patent [19]

Scheufler

[11] Patent Number: 5,249,793

[45] Date of Patent: Oct. 5, 1993

[54] GUIDING DEVICE FOR STACKING SHEETS OF PAPER

[75] Inventor: Gert Scheufler, Winnenden, Fed. Rep. of Germany

[73] Assignee: Eastman Kodak Company, Rochester, N.Y.

[21] Appl. No.: 796,965

[22] Filed: Nov. 25, 1991

[30] Foreign Application Priority Data

Dec. 13, 1990 [DE] Fed. Rep. of Germany ..... 4039813

[51] Int. Cl.[5] ..... B65H 31/26

[52] U.S. Cl. ..... 271/220; 271/207; 271/188

[58] Field of Search ..... 271/171, 180, 181, 188, 271/207, 220, 223, 224

[56] References Cited

U.S. PATENT DOCUMENTS

| | | | |
|---|---|---|---|
| 3,918,701 | 11/1975 | Lee | 271/181 |
| 3,975,010 | 8/1976 | Schisselbauer et al. | 271/180 X |
| 4,441,702 | 4/1984 | Nagel et al. | 271/177 |
| 4,735,408 | 4/1988 | Yamashita et al. | 271/213 X |

FOREIGN PATENT DOCUMENTS

| | | | |
|---|---|---|---|
| 0231961 | 8/1987 | European Pat. Off. | 271/177 |
| 0217466 | 9/1986 | Japan | 271/220 |
| 0217467 | 9/1986 | Japan | 271/220 |
| 0048768 | 2/1989 | Japan | 271/220 |
| 2215313 | 9/1989 | United Kingdom | 271/220 |

OTHER PUBLICATIONS

Craft, Paper Bin, 10-74, p. 1308, IBM Technical Disclosure Bulletin.

*Primary Examiner*—H. Grant Skaggs
*Assistant Examiner*—Carol Lynn Druzbick
*Attorney, Agent, or Firm*—Tallam I. Nguti

[57] ABSTRACT

In a guiding device for aligning sheets of paper (13) being stacked in a stacking tray (11) to which the sheets (13) are fed by means of a feeding mechanism (3, 5), deflectable fenders (25 and 26) are provided which are suspended from a mounting element (27) located above the path of the sheets and which extend into the path of each sheet (13), and are contacted and deflected by such sheet. The deflected fenders (25, 26) exert pressure on the contacting surface of the sheet so that the sheet when released by the feeding mechanism (3, 5) enters the stacking tray (11) from above in a controlled manner. At least one (26) of the fenders (25, 26) takes the form of a loop consisting of a flexible web (28) whose two ends are united and suspended from the mounting element (27). As suspended, the flexible loop makes and maintains large area contact with the sheet until stacked resulting in sheets aligned laterally with respect to one another in the stack.

11 Claims, 6 Drawing Sheets

GUIDING DEVICE FOR STACKING SHEETS OF PAPER

BACKGROUND OF THE INVENTION

1. Field of the Invention

The invention relates to a guiding device for stacking sheets of paper on the bottom of a stacking tray to which the sheets are fed by a feeding mechanism which releases them at a point which is higher than the bottom of the stacking tray so that the sheets released drop to the stacking tray, said device comprising a movable fender which extends from above into the path of movement of the incoming sheet, is deflected by said sheet and is arranged such that due to its weight the upper side of the sheet released by the feeding mechanism is subjected to a load.

2. Description of the Prior Art

Known guiding devices of this type are often used in sheet-handling apparatus which are connected to the output station of copiers, printers or the like. Such guiding devices may also be part of so-called finishers for example, i.e. units performing various finishing operations such as the stapling or folding of stacked sheets.

When paper sheets are to be deposited in apparatus of the above type they should form a properly aligned stack on the bottom of the stacking tray and not be displaced relative to each other. Normally, the bottom of the stacking tray is inclined relative to the vertical so that the sheets slide, in opposition to the direction in which they are fed in, towards the lower end of the stacking tray until their edges contact a paper abutment so that the sheets in the stack are longitudinally aligned (in the direction of feeding). In spite of the presence of one or more fenders which act from above on the paper sheets while they are dropping into the stacking tray and which by their weight are to urge the sheets in a controlled manner downwards in the direction towards the bottom of said tray, the danger exists that the sheets when dropping into the tray are laterally displaced (transversely to the direction of feeding).

SUMMARY OF THE INVENTION

It is an object of the invention to provide a guiding device of the type concerned wherein the formation of a perfect stack is ensured, and in particular the danger avoided of sheets being laterally displaced when superimposed in a stack.

According to the invention, this object is attained in a guiding device of the above-mentioned type in that the fender consists of a flexible web which extends at least into the vicinity of the bottom of the stacking tray.

Since the fender according to the invention consists of a flexible web it makes areal contact with a large area of the upper side of the paper sheet by which it is deflected. This large-area contact results in a guiding of the paper sheet which is much more effective than that achieved by conventional fenders which consists of relatively stiff strips and only make point contact with the paper sheet.

Since the fender according to the invention is long enough to extend at least into the vicinity of the bottom of the stacking tray, it guides the sheet released by the feeding mechanism not only during the phase in which the speed of the sheet is reduced, i.e. directly when the sheet starts its free fall after the feeding operation, but the fender remains in areal contact with the sheet until the sheet has dropped into the stacking tray and assumed its final position on the bottom of said tray. If the bottom of the stacking tray is downwardly inclined in opposition to the feeding direction, which is often the case in the devices concerned, the fender designed as a long flexible web not only guides the sheet during its free fall until it contacts the bottom but also during the phase in which the sheet slides along the inclined bottom of the stacking tray until it makes contact with the sheet abutment provided at the lower end of the tray.

The long flexible web readily adapts itself to various stack heights which are obtained in the tray depending on the number of paper sheets deposited.

The fender designed according to the invention may be used in addition to one or several fenders designed in a conventional manner. In such cases, the fender according to the invention is preferably arranged in an area inwardly offset from the lateral edges of the paper sheet towards the central line of the feeding path while the one or several fenders of the conventional type is/are aligned with the lateral marginal areas of the paper sheet.

A particularly satisfactory guiding effect is attained if both ends of the flexible web forming the fender are united to form a loop and the web is suspended from the area of its united ends. In the case of such a design, the fender contacts the upper side of the sheet in the form of a pressure pad having a drop-shaped cross-section, with the shape of said drop changing during movement while areal contact continues until the sheet has finally been deposited.

BRIEF DESCRIPTION OF THE DRAWINGS

The invention will be described in the following with reference to the embodiments shown in the drawings in which:

FIGS. 1 to 5 show a first embodiment of the device according to the invention which cooperates with the sheet-output station generally denoted 1. The output station 1 may be, for example, part of a copier or may belong to a so-called finisher, i.e. a sheet-handling apparatus connected with a copier.

DETAILED DESCRIPTION OF THE PREFERRED EMBODIMENT

Figure 5:
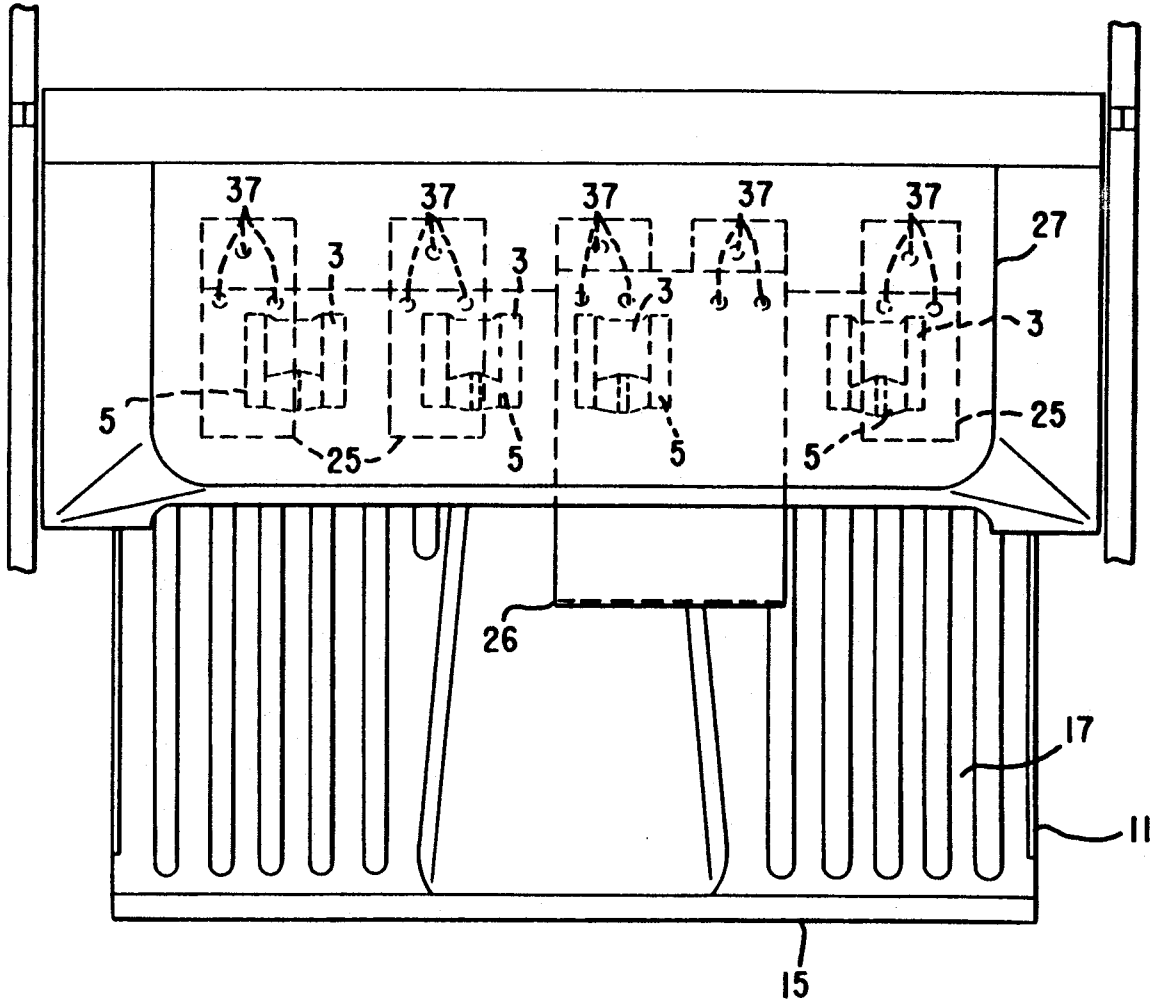
FIG. 5 shows a schematic plan view of the embodiment.

The output station 1 comprises pairs of cooperating upper and lower transport rollers 3 and 5, respectively, of which the lower rollers 5 are driven by a motor. As can be seen in FIG. 5, the embodiment includes four pairs of transport rollers 3, 5. The upper rollers 3 each have a central peripheral indentation which cooperates with the raised peripheral portion of the lower rollers 5 in a manner known for such sheet-transport devices such that a stiffening effect is attained for the paper sheet fed through the nip of the rollers. The upper rollers 3 are mounted to one end section of a roller holder 7 whose end area facing away from the rollers 3 is pivotally mounted to the frame of the device so that the upper rollers 3 can be separated from the lower rollers 5 in opposition to the force of a spring (not illustrated) which engages holder 7. At its end section adjacent to the rollers 3, the holder 7 carries a brush 9 whose bristles have an antistatic effect and extend into the feeding path of the sheet of paper 13 transported through the rollers 3 and 5 at a point located downstream of the rollers 3, 5 whose feeding direction as seen in the Figs. is from the right to the left.

Figure 1:
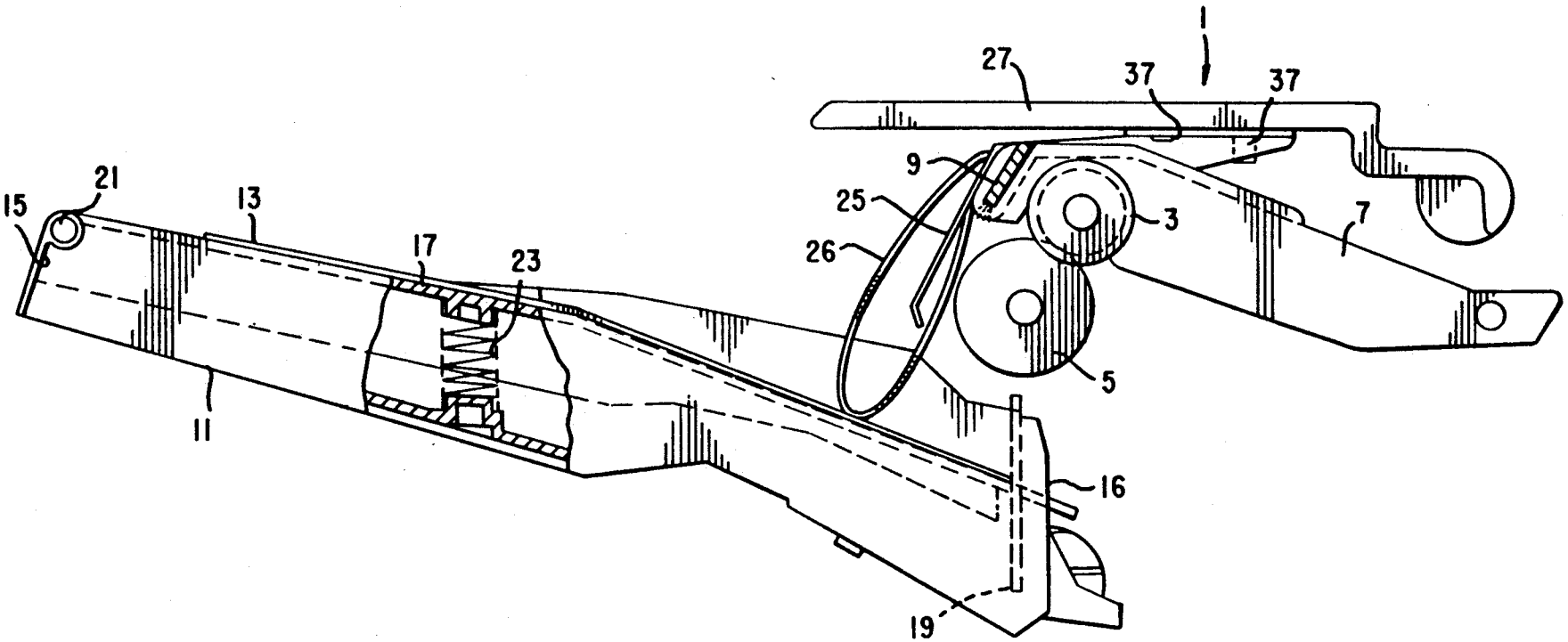
FIG. 1 shows a schematic sectional lateral view of an embodiment of the device, with parts broken away.

A stacking tray 11 in which the sheets of paper 13 supplied are to be deposited in an orderly stack in which all superimposed sheets are aligned is inclined with respect to the horizontal such that its downstream end 15, as seen in the direction of feeding, is higher than its upstream end 16. The rollers 3, 5 are disposed in the area above said lower end 16 of stacking tray 11. With such an arrangement, the feeding path of the sheets 13 supplied by the rollers 3, 5 terminates in about the area above the adjacent lower end 16 of the stacking tray so that the sheets of paper 13 are released by the rollers 3, 5 as soon as the trailing ends of the sheets 13 are located above the area of the lower end 16 of stacking tray 11. The released sheets 13 drop into the stacking tray 11 and owing to the inclination of bottom 17 thereof, are disposed in the tray such that their trailing ends contact a sheet abutment 19 provided at the lowered end 16 of stacking tray 11. FIG. 1 shows a state of operation in which a single sheet 13 has been deposited on the bottom 17 of stacking tray 11 and has come to rest against abutment 19.

Figure 4:
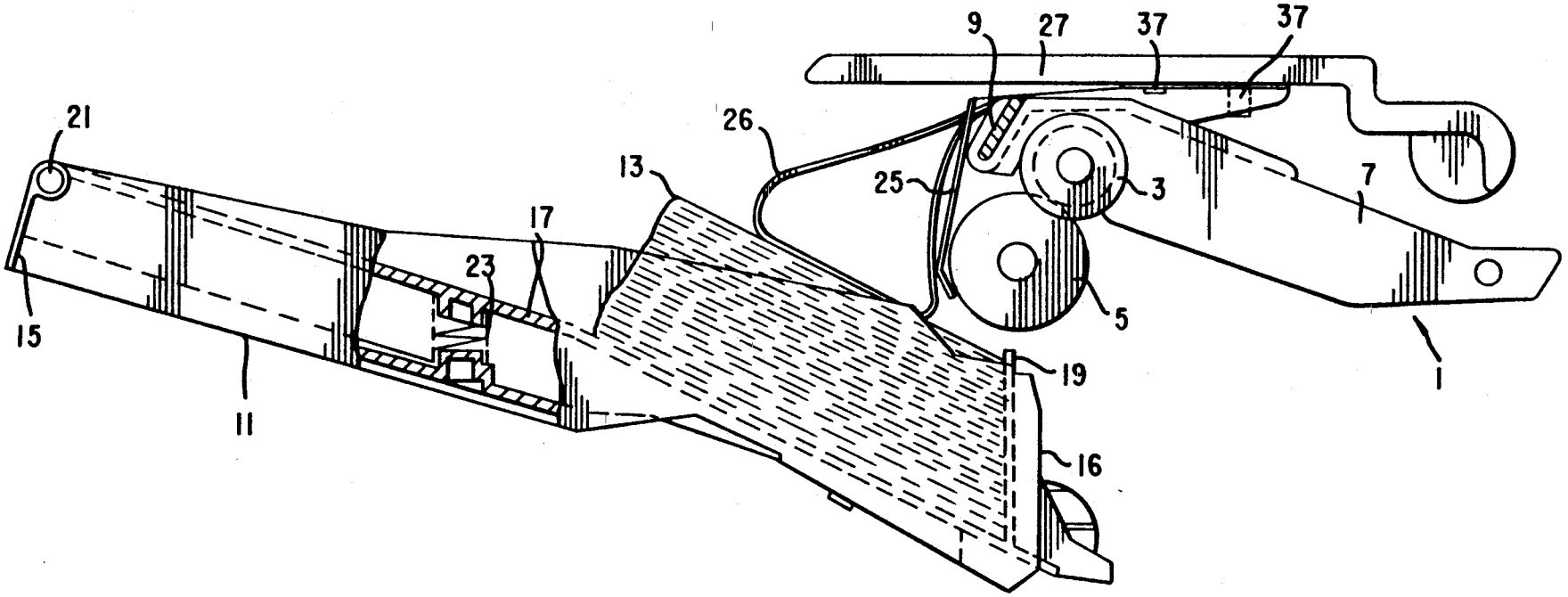
FIG. 4 shows a view similar to that illustrated in the preceding FIGS. with a sheet stack deposited in the stacking tray.

In the area of the higher end 15 of the stacking tray 11, the bottom 17 is pivotable about a horizontal journal 21 and supported by a helical spring 23 against pivotal movement caused by the action of weight, said helical spring engaging the lower side of bottom 17 in about the center thereof. Bottom 17 is pivotable clockwise in opposition to the force of spring 23 so that it can be lowered in the area of the lower end 16 of stacking tray 11 if the weight of a stack of sheets 13 deposited on bottom 17 exceeds the action of the supporting spring force, as is illustrated in FIG. 4.

Figure 2:
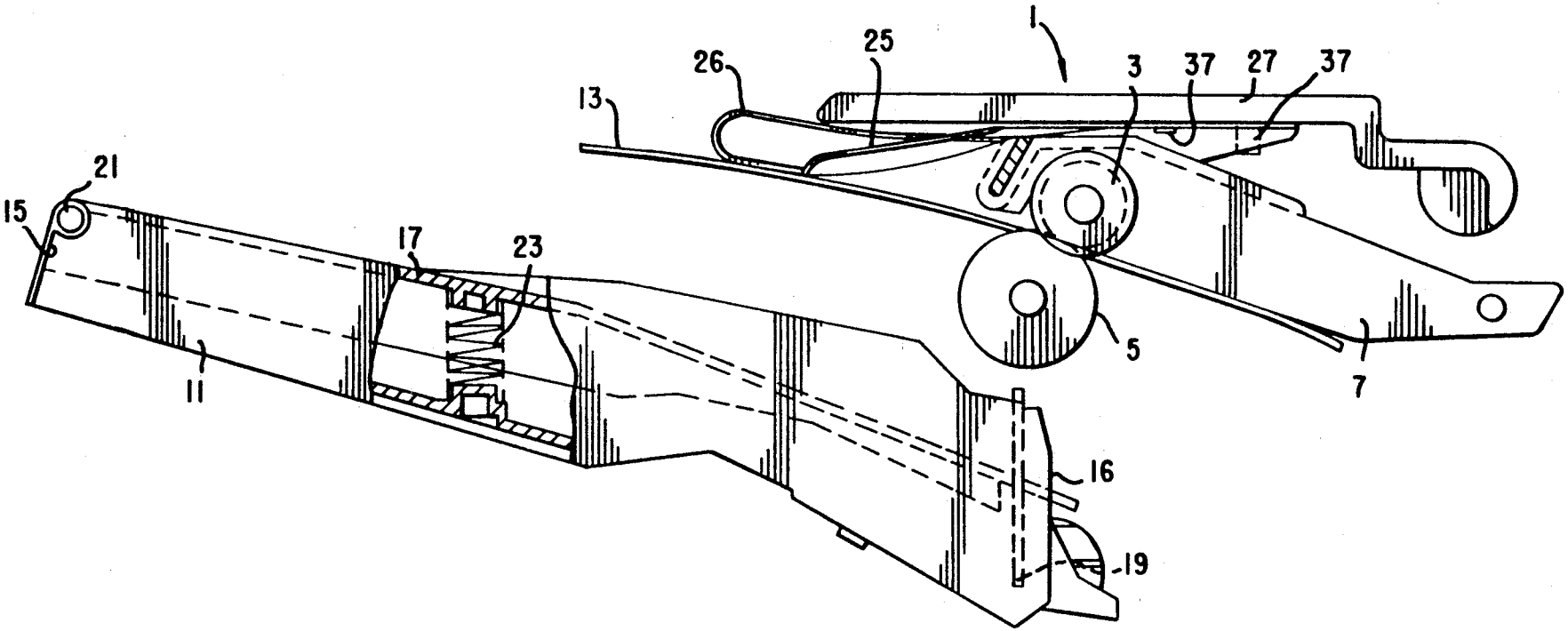
FIGS. 2 and 3 show views similar to FIG. 1 with parts of the device illustrated in operating positions which differ from those shown in FIG. 1.

FIG. 2 shows a state of operation in which the sheet of paper 13, which in the illustration according to FIG. 1 has already been deposited in stacking tray 11, is still held in feeding engagement with the rollers 3, 5.

Figure 3:
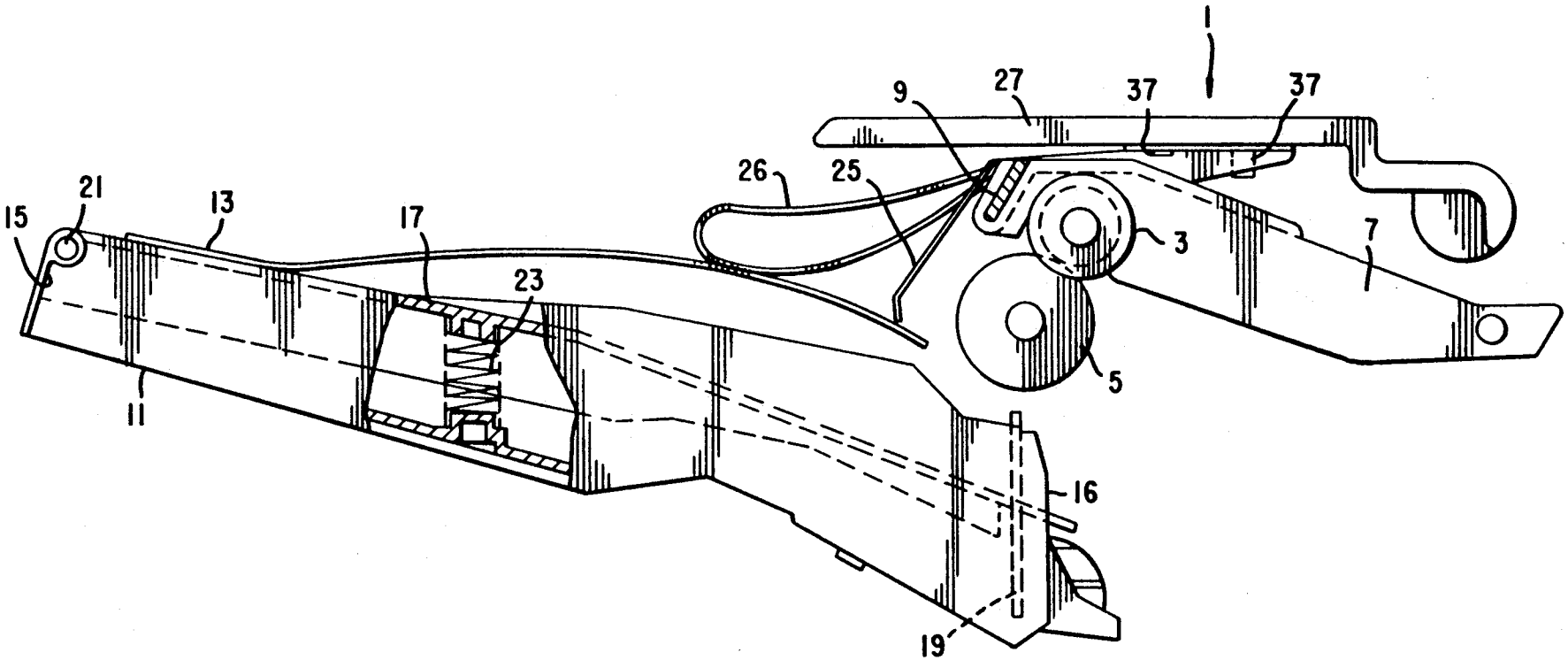

Three sheet fenders 25 and one sheet fender 26 are freely suspended from a mounting element 27 provided above the feeding path. The sheet of paper 13 which according to the illustration in FIG. 2 has not yet been released by the rollers 3 and 5 deflects the sheet fenders 25 and 26 during its movement. FIG. 3 shows the state directly after the release of the sheet of paper 13 which under the action of weight drops into the stacking tray 11.

The fenders 25 and 26 are basically of a different design. The fenders 25 are of the type usual in paper sheet guiding devices, i.e. they consist of plastic strips which are attached to the respective mounting element 27 such that they are suspended substantially freely from said mounting element 27 which in the case of the embodiment is designed as a lid-type upper cover of the device which can be removed by pivoting. Such plastic strips have a thickness of about 0.2 mm and represent relatively stiff elements so that they can be pivoted when deflected by the sheet of paper 13, as shown in FIG. 2, but cannot be substantially deformed. As can be inferred from FIG. 5 one fender 25 each is arranged in the area of each lateral edge of the feeding path in the case of the embodiment.

Figure 6:
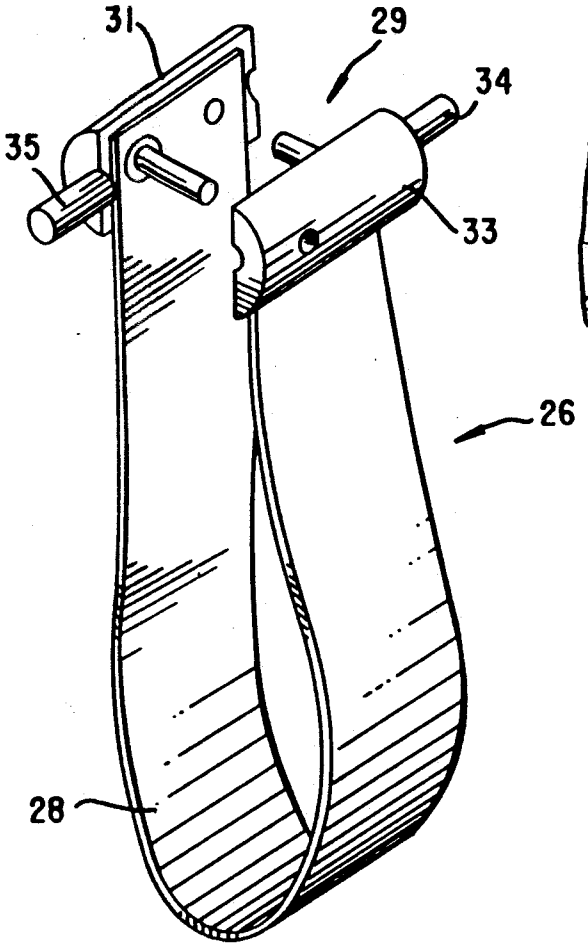
FIG. 6 shows a perspective view, illustrated on a larger scale than the other FIGS., of a loop-type fender for use in a second embodiment of the device.

Adjacent to one of the outer fenders 25, a fender 26 of a different design is arranged more inwardly, see FIGS. 5 and 6. Fender 26 has a drop-like cross-section and consists of a loop of a plastic-web 28 which is suspended for substantially free movement from the mounting element 27, see FIG. 6. The two ends of the loop of the plastic web 28 are united at the upper loop end, i.e. in the area where they are suspended from mounting element 27. The web 28 consists of a plastic sheet material which is very flexible. If a smooth and highly flexible plastic material such as a polyamide is used which is sold under the trademark Supronyl (Hoechst) the thickness of the sheet material is about 0.1 to 0.13 mm depending on the properties (stiffness, weight, surface roughness) of the sheets of paper to be deposited. In the present example, the web 28 is about 90 mm wide. Owing to its flexibility the fender 26 represents a relatively easily deformable structure so that the drop shape of the loop of the web 28 which forms the fender 26 changes by interaction with the sheets of paper 13, as is revealed by a comparison of FIGS. 2 to 4.

The functioning of the embodiment will now be explained with reference to FIGS. 1 to 4. FIG. 1 shows the state of operation in which a first sheet of paper 13 which has previously been supplied has been deposited on the bottom 17 of the stacking tray. Owing to the inclination of bottom 17, the sheet of paper 13 has moved towards the lower end 16 so that it rests with its trailing edge, as seen in the feeding direction, on abutment 19. Since the bottom 17 is not subjected to the weight of a sheet stack of sufficient height it is disposed in its uppermost position under the bias of spring 23.

FIG. 2 shows the state of operation before the first sheet of paper 13 is deposited on bottom 17 of stacking tray 11. The trailing section of sheet 13 is still engaged by the rollers 3, 5 while the leading section has already contacted the fenders 25 as well as the fender 26 and deflected them such that they slide on the upper face of sheet 13 and by their weight exert pressure on that face.

FIG. 3 shows the state of operation after the trailing end of sheet 13 has been released by the rollers 3, 5. Under the action of gravity, the sheet has been lowered so far that its leading edge rests on bottom 17 of stacking tray 11. Its trailing section is subjected to the loop-type fender 26 whose loop forming an easily deformable drop rests like a pressure pad on the upper face of sheet 13 and urges that sheet section downwards. The length of the loop of fender 26 has been chosen such that the sheet 13 keeps contact with the loop until it rests on bottom 17 as shown in FIG. 1. As a result of the way in which the sheet 13 is guided by the flexible loop of fender 26 when dropping onto the bottom 17 of the stacking tray 11 successively supplied sheets 13 are deposited in perfect order and alignment on a stack. As illustrated in FIG. 4, the pivotable bottom 17 tilts downwards in opposition to the force of spring 23 when the stack becomes higher. When the stack has grown to a height which exceeds the length of the downward movement of the bottom 17 the drop shape of the fender 26 is increasingly deformed. Independently of the distance between the surface of the stack formed and the feeding path, however, the fender 26 rests in the form of a drop-shaped pressure pad on each sheet 13 to be deposited until the next sheet 13 is supplied and the fender 26 as well as the other fenders 25 are once again deflected.

The stacking tray 11 may be movable transversely to the feeding path in order to enable sheets stacks to be formed of a plurality of staggered partial stacks as is usual in such devices. In such a case, the shifting of the stacking tray 11 is controlled such that the shifting movement occurs when the fender 26 is deflected by a freshly supplied sheet of papers 13, i.e. lifted off the stack.

Figure 7:
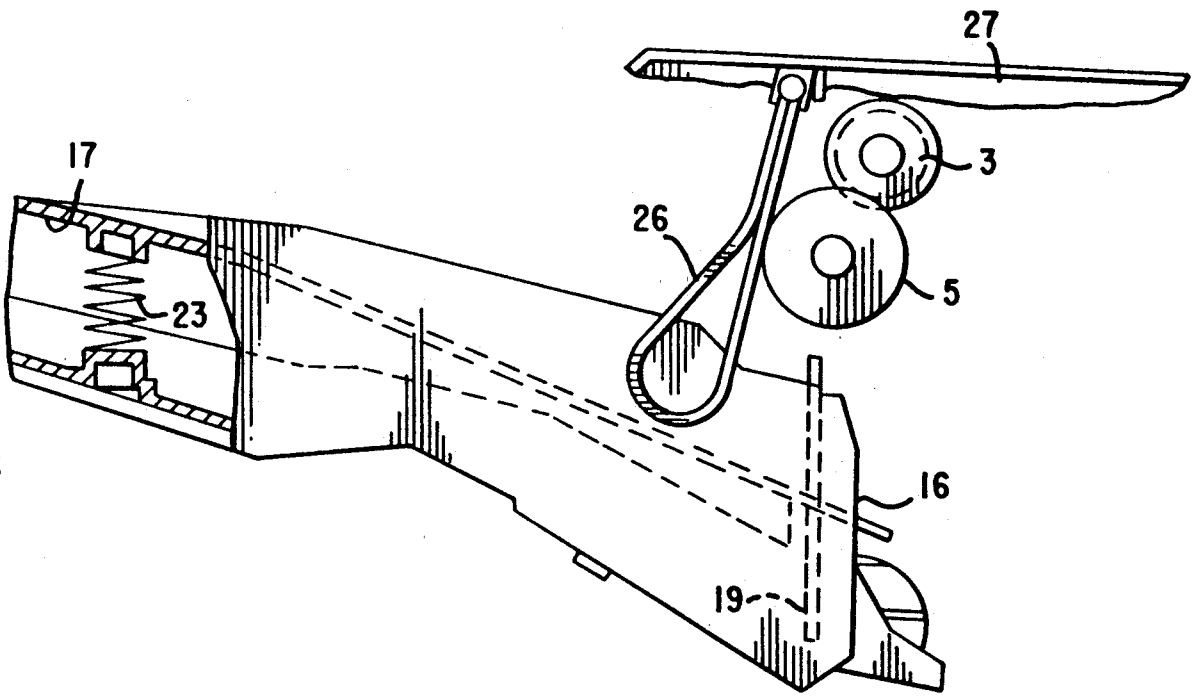
FIG. 7 shows a schematical partial lateral view of the second embodiment of the device.

FIG. 6 illustrates the fender 26 whose plastic web 28 is united at the loop ends by means of a holder 29 which is composed of two connectible clamping elements 31 and 33 between which the web ends are held. The clamping elements 31, 33 have lateral journals 35 and 34, respectively. This design is intended for the second embodiment of the device which is only partially shown in FIG. 7 (e.g., without fenders 25). This embodiment differs from the embodiment described with reference to FIGS. 1 to 5 in that the drop-shaped fender 26 is hinged to the upper mounting element 27 by means of journals 34 and 35. In contrast to this second embodiment, the plastic web 28 of fender 26 according to the first embodiment described with reference to FIGS. 1 to 5, is not hinged to the mounting element 27 by a holder provided with journals but directly secured on mounting element 27 by means of rivets 37. The stiff fenders 25 are also fastened by means of rivets 37 in the case of the first-mentioned embodiment.

The above description and the drawings are confined to features which are essential to describing an example of an embodiment of the invention. Inasmuch as such features are included in the description and the drawings but to mentioned in the claims they also serve to define the subject matter of the invention.

What is claimed is:

1. A guiding device for aligning sheets of paper (13) being stacked on a stacking tray (11) backwardly inclined relative to a sheet feeding direction to which the sheets are fed by a feeding mechanism (3, 5) which releases the sheets at a point higher than the bottom (17) of the stacking tray (11), said guiding device comprising a deflectable fender (26) which extends from above into the path of an incoming sheet (13) and is contracted and deflected by said sheet, said fender (26) being arranged such that due to its weight the upper side of the sheet (13) in contact therewith is subjected to a load, said guiding device characterized in that said fender (26) consists of a flexible web (28) that forms a tear-drop loop that is compressively flattened when deflected forwardly by a sheet feeding into the tray (11) and that is re-expanded by the sheet sliding backwardly under gravity in the tray (11).

2. A guiding device according to claim 1, characterized in that the width of said web (28) is at least one third of the width of the sheet (13) and in that said web is arranged such that it acts on the sheet (13) at a distance from both of the lateral edges of such sheet (13).

3. A guiding device according to claim 1, characterized in that the ends of the loop are united in a holder (29) and in that said holder is suspended from the mounting element (27) for substantially fel movement.

4. A guiding device according to claim 3, characterized in that the holder (29) is pivotably suspended from the mounting element (27) by means of journals (34, 35) for allowing free lateral movement of said guiding device.

5. A guiding device according to claim 4, characterized in that said web (28) consists of a smooth plastic sheet.

6. A guiding device according to claim 5, characterized in that the plastic sheet is polyamide, and in that the thickness thereof is about 0.10 mm so as to make said loop very deformable.

7. A sheet stacking device for stacking sheets being moved one at a time thereto, the device comprising:

(a) a sheet stacking tray having a bottom, a downstream end relative to the direction of sheet movement, and an upstream end being lower than said downstream end, said sheet stacking tray being supported pivotally at said downstream end for enabling pivotal movement of said upstream end between a raised position, and a lowered position under load of a stack of sheets; and (b) a sheet guiding member having a tear-drop shape and including a loop end and a narrow end, said guiding member being suspended at said narrow end for substantially free movement, and said loop end compressively flattening when deflected and moved downstream by a sheet being fed into said stacking tray bottom, and deformably expanding when moved backwards by said fed sheet sliding gravitationally on said bottom of said stacking tray from said raised downstream end towards said upstream end of said stacking tray.

8. The sheet stacking device of claim 7 including a pair of upper and lower rollers for feeding a sheet onto said bottom of said stacking tray, one of said upper and lower rollers having a peripheral indentation and the other of said upper and lower rollers having a cooperating raised peripheral portion for cooperatively creasing and stiffening a sheet being fed thereby.

9. The sheet stacking device of claim 7 wherein said sheet stacking tray is shiftable laterally relative to said sheet guiding member for forming a stack of aligned and staggered sheets.

10. The sheet stacking device of claim 7 including a compressible spring supporting said pivotable bottom of said stacking tray against the weight of a stack of sheets.

11. The sheet stacking device of claim 10 wherein said compressible spring is mounted mid-point between said downstream and upstream ends of said sheet stacking tray.

* * * * *